US005361546A

United States Patent [19]

Jönsson

[11] Patent Number: 5,361,546

[45] Date of Patent: Nov. 8, 1994

[54] APPARATUS FOR GRINDING, POLISHING ECT. OF WORKPIECES

[76] Inventor: Holger Jönsson, Tylla 4, S-781 94 Borlänge, Sweden

[21] Appl. No.: 969,300

[22] PCT Filed: Aug. 14, 1991

[86] PCT No.: PCT/SE91/00537

§ 371 Date: Feb. 9, 1993

§ 102(e) Date: Feb. 9, 1993

[87] PCT Pub. No.: WO92/03258

PCT Pub. Date: Mar. 5, 1992

[30] Foreign Application Priority Data

Aug. 15, 1990 [SE] Sweden ..... 9002666-7

[51] Int. Cl.[5] ..... B24B 21/20

[52] U.S. Cl. ..... 451/310; 451/311; 451/296

[58] Field of Search ..... 51/135 BT, 135 R, 148, 51/147

[56] References Cited

U.S. PATENT DOCUMENTS

| | | | |
|---|---|---|---|
| 825,712 | 7/1906 | Evans et al. | 51/148 |
| 2,751,724 | 6/1956 | Polzer . | |
| 3,024,575 | 3/1962 | Dreiling | 51/135 |
| 4,669,224 | 6/1987 | Armstrong et al. | 51/148 |

FOREIGN PATENT DOCUMENTS

| | | | |
|---|---|---|---|
| 0038763 | 10/1981 | France | 51/76 R |
| 3114615A1 | 10/1982 | Germany . | |
| 394858 | 12/1965 | Switzerland . | |
| 1018841 | 5/1983 | U.S.S.R. | 51/148 |

*Primary Examiner*—Robert A. Rose

*Attorney, Agent, or Firm*—Frishauf, Holtz, Goodman & Woodward

[57] ABSTRACT

An apparatus arranged for grinding, polishing, etc. with a closed loop 5 of grinding, polishing, etc. belt mounted on the output shaft of a motor 1 and driven by a rotating drive wheel 4. This loop belt 5 is intended to be applied against a workpiece which is to be machined by means of the loop belt 5, said closed loop 5 having loop portions differing from one another in a running direction. The loop 5 is steered by steering members 2:8, 9:10, 11 to adopt an essential L-shape and comprising at least two loop portions, of which the loop portion 5*d* which is arranged to make contact with said workpiece is preferably selected shorter than the other loop portion 5*a*, 5*b*, 5*f*, 5*g*.

Said drive wheel 4 for driving of the belt 5 is arranged displaceable relative to a foundation 17 by a guide 19 steered by the foundation 17 and turnable by means of guide members 3 arranged on the guide. An angle $\phi$ existing between the L-shaped coil portions 5*a*, 5*b*, 5*g*, 5*f* and 5*c*, 5*d*, 5*e* respectively of the loop 5 is resettable, for instance by means of resetting members 16 and is lockable by means of locking members 14, 15.

13 Claims, 3 Drawing Sheets

APPARATUS FOR GRINDING, POLISHING ECT. OF WORKPIECES

BACKGROUND OF THE INVENTION

1. Field of the Invention

The present invention relates to an apparatus arranged for grinding, polishing, etc. with a closed loop of grinding, polishing etc. belt mounted on the output shaft of a motor and driven by a rotating drive wheel, said loop belt or endless belt being intended to be applied against a workpiece which is to be machined by means of the loop belt, said closed loop having loop portions differing from one another in a running direction, the loop being steered by steering members to adopt an essentially L-shape and comprising at least two loop portions, of which the loop portion which is arranged to make contact with said workpieces is preferably selected shorter than the other loop portion.

Particularly in continuous processes for machining of materials into finished products, there is a requirement for the machines which perform the machining to demand little space in order for room to be made available for all machines. The same requirement for compactness also often applies to individual machines. The above requirement is often coupled to a demand that the machining, closed belt loop or endless belt shall be long in order to ensure a long service life and effective machining during long working sessions without any or with only a few changes during each working session. In prior-art technology, long belt loops have involved a demand for a large space in order to contain the belt loop, particularly in the horizontal plane, since machining is frequently to be carried out on surfaces which are both horizontal and vertical or in between, for instance on window mouldings of wood, which are usually produced in a continuous process.

Long, endless belts in themselves give rise to certain problems in profile polishing, for instance with stability in the transverse direction to the direction of rotation of the belt. Because of this, the risk is incurred that the belt loop can easily migrate to the side of the workpiece, resulting in disruption of production and a need for action on the part of the personnel.

DESCRIPTION OF THE PRIOR ART

One example of prior-art technology for solving the problem of stability in the transverse direction in a long, endless belt is evident from Swiss patent description No. 394 858, in which belt steering members 26*a* are utilized to steer the belt in the sideways direction. U.S. Pat. No. 2,751,724 shows a different prior-art technique for coping with belt control in the sideways direction, namely by diverting the belt loop at a right angle via an inclined, stationary surface 14. German Offenlegungsschrift No. DE 31 14615 describes a third prior-art technique, namely utilization of additional diverting rollers to arrange the machining belt loop in an L-shaped configuration and using a support surface 40 to steer the belt loop, the outer contour of said support surface being adapted to the wanted machining shape. None of these prior-art methods is capable of simply and quickly resetting the angle of approach to the workpiece of the machining loop.

In a continuous machining process resetting shall be able to be performed in order for the belt loop also to be able to machine the workpiece in an inclined direction, for example against a bevelled surface on a window moulding. In the continuous process, the workpiece is usually fed forwards on a given vertical level. From this it follows that it is highly desirable to be able to easily and quickly alter the angle of attack of the belt loop against a workpiece which is fed forwards in a given horizontal direction. It is likewise frequently desirable to be able to change the vertical level of attack of the belt loop against the workpiece in a simple, convenient and rapid manner.

SUMMARY OF THE INVENTION

The object of the present invention is to reduce to a large extent the need of space for a machining machine with a belt loop, viewed in a horizontal plane, while utilizing long belt loops for effective machining, and to take actions so that the risk of the belt loop migrating in the sideways direction is reduced to the greatest possible extent while simultaneously aspiring to maximum flexibility and swiftness when it comes to setting of different directions of attack against the workpiece and replacement or changing of belt loops.

The invention is characterized in the apparatus mentioned in the descriptive preamble in that the said drive wheels for driving of the belt are arranged in relation to a foundation for the apparatus to be movable by a guide steered by the foundation and twistable by means of guide members provided on the guide and in that an angle $\phi$ existing between the L-shaped loop portions of the loop is resettable, for instance by means of resetting members, and is lockable by means of locking members.

BRIEF DESCRIPTION OF THE DRAWINGS

The nature of the present invention and its aspects will be more readily understood from the following description of the accompanying Drawings, and discussion relating thereto. In the accompanying drawings.

DETAILED DESCRIPTION

Although the machine described below is intended for grinding with an endless belt it is evident that the present invention can be applied to all types of machines in which endless, i.e. closed loops or belts are utilized for polishing, trimming, grinding etc.

Figure 4:
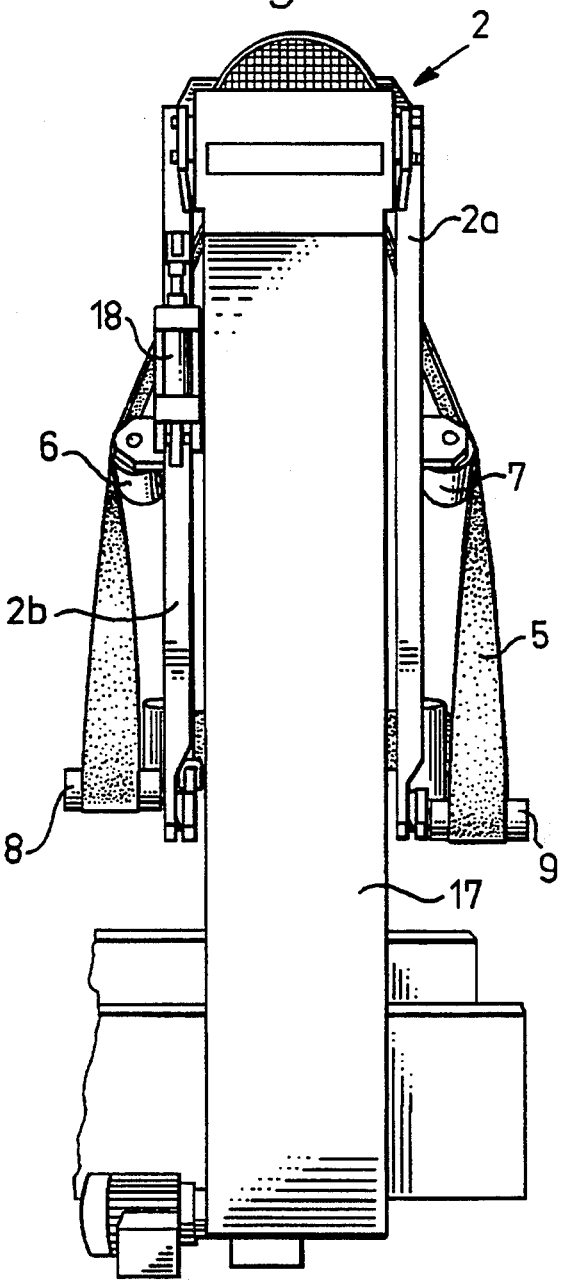
FIG. 4 shows the entire machine, including the whole pillar and the stand for this, essentially in the position according to FIG. 1 but viewed from behind.

The machine according to the present invention comprises, as is especially evident from FIG. 4, a firm and/or heavy foundation which—if required—can be anchored to the underlying surface on which it stands, for instance to the floor. In principle, the foundation comprises a pillar 17 in the form of, for example, a box-shaped beam with a small base, i.e. occupying but little floor space. The extent or height of the pillar 17 is chosen so big that it essentially exceeds all conceivable machining levels and angles with a margin. In the upper portion of the pillar 17 and inside or alternatively outside this run one or a plurality of guides 19 steered by the pillar 17, which guide or guides in turn is/are connected to a suspension device 2, generally designated in the figures of the drawings, said suspension device 2 thus being arranged displaceable as a unit in relation to the pillar 17 with the aid of, for example, a bolt, pneumatic or hydraulic piston and cylinder device—not shown in the drawings—which is appropriately located within the said hollow pillar 17 and works between the lower portions of the guides 19 and the bottom of the hollow pillar 17 (the foundation of the machine), the movement of which device is controlled from a control panel 12 located on the front of the pillar 17 or the machining side of the machine in a vertical level which corresponds to an adapted level suitable from the standpoint of both visual and handling ergonomics.

The suspension device 2 is turnably connected via guide members 3 to the guide or guides 19 so that when the guide or guides 19 is/are moved by the aforesaid piston and cylinder device in relation to the hollow pillar 17 the suspension device 2 is moved and in applicable cases twisted in relation to the pillar 17.

Figure 1:
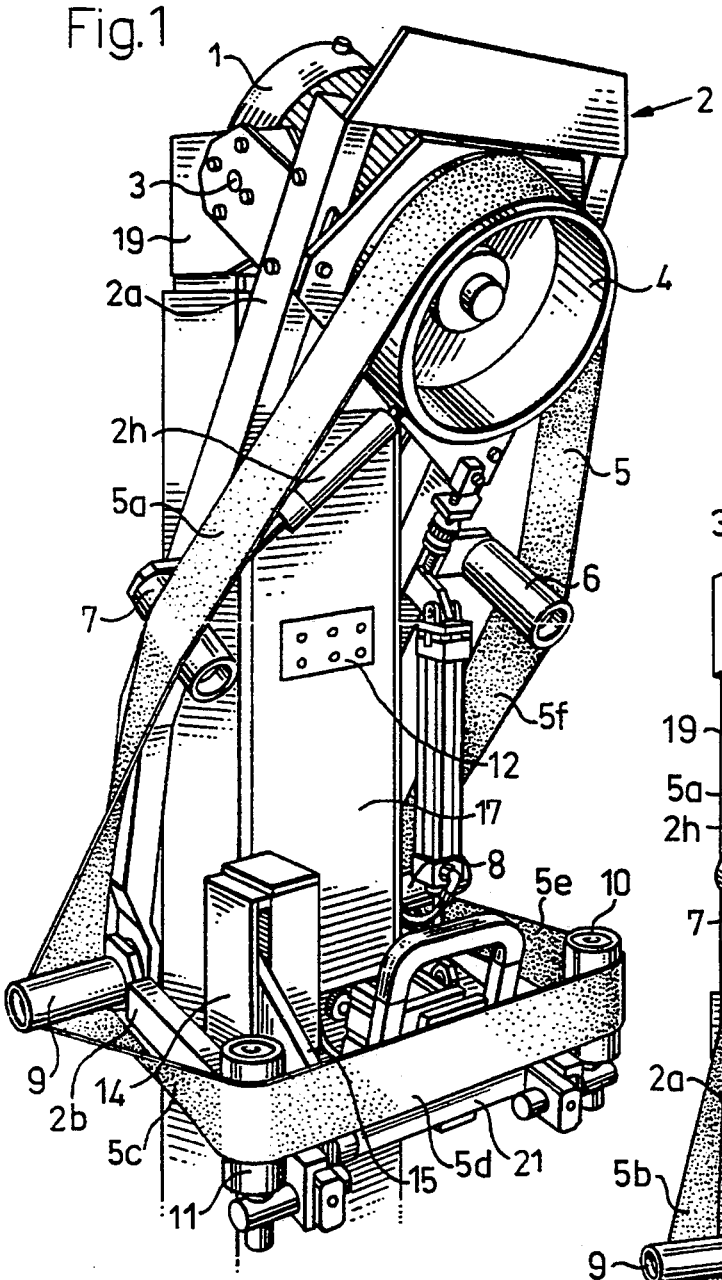
FIG. 1 shows obliquely from above a part of a machine with the exception of a portion of the pillar which supports the machine, for grinding of for instance wooden mouldings from the side.
Figure 2:
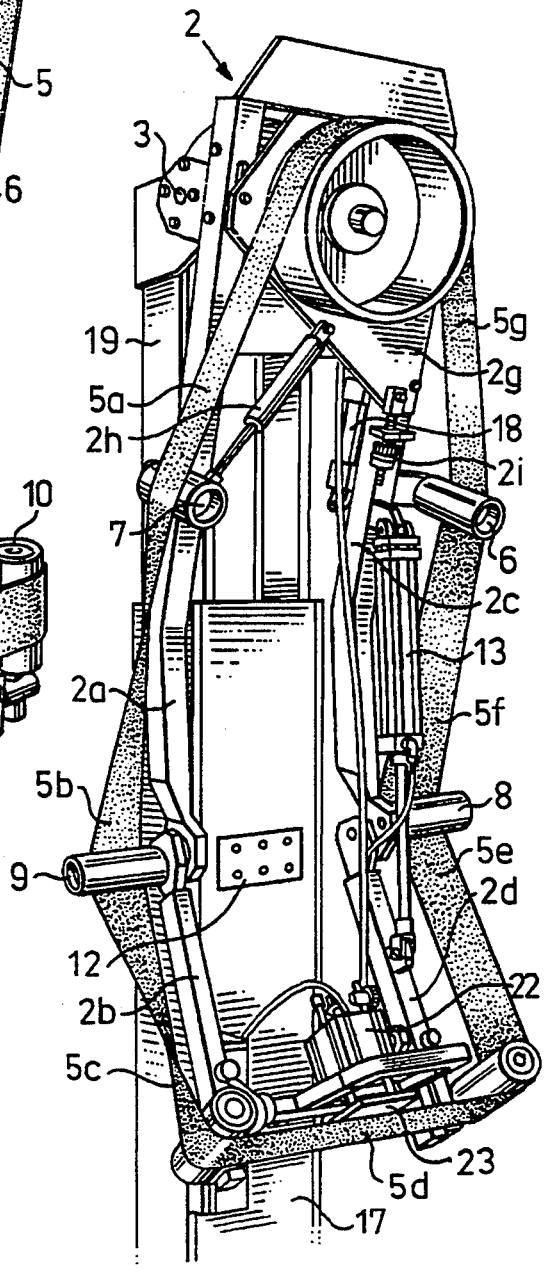
FIG. 2 shows the same machine as in FIG. 1 but reset to grind the same moulding as according to FIG. 1 obliquely from above.

Suspended in a suspension device 2 in a plate **2*g* thereof–see FIG. 1 and FIG. 2—is a drive motor 1, appropriately electric, the output shaft of which is connected to a drive wheel 4 in order for a machining belt 5, for instance a belt coated with abrasive on one side for polishing of a workpiece. The plate 2*g* is in turn displaceable relative to but attached to the suspension device 2 and can, by means of manoeuvering from control panel 12 through the intermediary of a pneumatic piston and cylinder device 18, be displaced a certain distance so that the machining belt 5 placed over the drive wheel 4 is tensioned over drive wheel 4. The said piston and cylinder device 18 thus work between the plate 2*g* and the suspension device 2, more specifically between the first arm 2*c* of the suspension device 2 and the back of the plate 2*g*. The movement of the plate 2*g* in relation to the suspension device 2 is limited in magnitude by an adjustable screw device 2*i* and the magnitude of the belt tension can thus be adapted by actuation of this screw device 2*i* to a suitable setting for different permissible belt tensions, for instance belts with differing widths. Additionally, a double-acting gas spring 2*h* works between the plate 2*g* and the second arm 2*a* of the suspension device 2 and reacts in the event that the pressure of the belt-tensioning piston and cylinder device 18 should be lost for any reason so that the belt 5, in the event of such loss of pressure, does not risk falling off or being fed away from the drive wheel 4. For removal of the belt 5 from the drive wheel 4 resetting of a valve which controls the piston and cylinder device 18 is required, so that the latter pulls and overcomes the pressure of the gas spring 2*h***.

The suspension device 2 thus comprises—as indicated above—a first arm **2*c* and a second arm 2*a* in relation to which arms 2*c* and 2*a* the said plate 2*g* with drive assembly 1, 4 is adjustedly arranged. The said first and second arms 2*c* and 2*a* extend at a mutual distance which is appropriately larger than the diameter of the drive wheel 4 and preferably symmetrical on either side of the hollow pillar or box beam 17 and are each provided with a first roller 6 and a second roller 7, said rollers being located along the respective arms 2*c* and 2*a* roughly in the middle of the respective arm, the said rollers 6, 7 being directed so that their exterior surfaces work in principle parallel to the active surface of the drive wheel 4 for the machining belt 5, whereby the first and second roller 6 and 7 act in principle as diameter enlargers for the drive wheel 4. Pivotally attached to the outer, lower ends—shown in the drawings—of the first arms 2*c* and second arms 2*a* is a third arm 2*d* and a fourth arm 2*b*** respectively.

In or in the immediate vicinity of the said pivoted attachments are a third roller 8 and a fourth roller 9, the latter third roller 8 and fourth roller 9 being appropriately directed at essentially a right angle from the first and second rollers 6, 7, whereby the machining belt running over the third and fourth rollers 8 and 9 is not only diverted but also twisted and thus stretched more in the outer edges than centrally. In this context it should be noted that all rollers in the machine, for support of the machining belt 5, are meticulously journalled with easily running, suitable ball bearings, roller bearings etc., adapted for a high load and high speed and that all said rollers have surfaces which is essentially comprise smooth jacket surfaces and the extents of which are chosen to advantage not unessentially larger than the width of the machining belt 5.

Arranged in connection with the outer ends of the third and fourth arms **2*d* and 2*b*, further, are a fifth roller 10 and a sixth roller 11 respectively, across which rollers 10, 11 the machining belt 5 also runs. The latter two rollers 10, 11 are oriented essentially at a right angle in relation to the third and fourth rollers 8, 9, but their angles can be slightly adjusted as is explained in more detail below. It should be noted here that the machining belt 5** is not only diverted but also twisted and thus stretched more in the outer edges than centrally.

The machining belt 5 acquires—as is especially evident from FIG. 1 and FIG. 2—momentaneously at every instant upon rotation of the drive wheel 4 different subsections with varying running directions, a first section **5*a* of the machining belt running straight from the drive wheel 4 to the second roller 7, where the running direction of the belt is diverted, from the second roller 7 to the fourth roller 9 the belt is twisted in a second section 5*b* and also changes running direction at the fourth roller 9. The distance between the roller 7 and 9 is chosen in relation to the largest belt width which it is proposed to make use of the machine, depending on the desired tensioning of the edges of the belt 5 in relation to the centre of the belt 5 at the machining point, since upon twisting of the belt 5 the edges of the belt are forced to run a longer distance than the centre of the belt. In a third section 5*c* the running direction of the belt 5 is determined by the sixth roller 11, the belt 5 being twisted in this section also. In section 5*d*—where machining of the workpiece is intended to take place—the belt 5 runs straight and preferably virtually horizontally between the sixth roller 11 and the fifth roller 10. In section 5*e* between the fifth roller 10 and the third roller 8, the belt is diverted by the fifth roller 10 to a new running direction and is twisted by the third roller 8, in section 5*f* the belt 5 is diverted by the third roller 8 to a new running direction and is twisted by the first roller 6 and, finally, in section 5*g*, the belt runs straight. In this context it should be noted that the machining belt 5 has its one side which is coated with abrasive, polishing agent or some other agent, faces away from the roller 6–11 and from the drive wheel 8, and that all rollers 6–11 are advantageously cylindrical in the surface which contacts the belt 5, that is to say that the said rollers, in principle, do not need to be cambered in order to steer the belt 5**.

Depending on the direction of rotation allocated to drive motor 1 and thereby to drive wheel 4, the machining belt 5 will thus, either at the fifth roller 10 or at the sixth roller 11, be powerfully tensioned in the other edges in relation to the centre of the belt 5, whereby the result will be that between the fifth and sixth rollers 10, 11, the belt 5 is tensioned centrally whereas in contrast the outer edges of the belt 5 are extremely flexible, a circumstances which has as a consequence that the belt 5, despite being thoroughly tensioned centrally, is capable of adapting itself easily and flexibly at the outer edges to various shapes of the workpiece to be machined, as dealt with in greater detail below.

The third arm 2*d* and the fourth arm 2*b* are largely identical in design but mirror-imaged in relation to each other, as is particularly evident from FIG. 5, and for this reason a description of these arms will first be made with designation of the paths common to both arms, after which differences between these arms will be dealt with.

Figure 5:
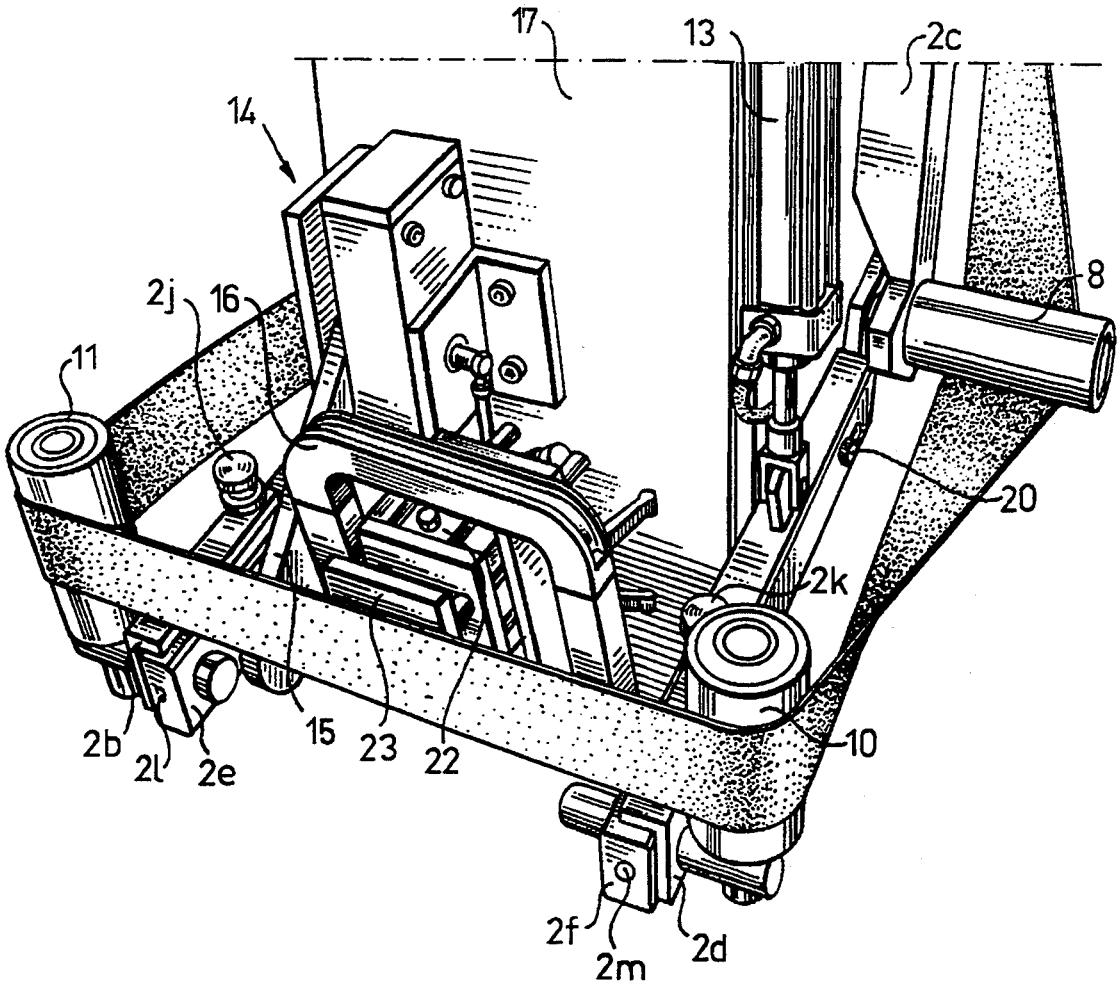
FIG. 5 shows more closely certain parts of the machine.

The third arm 2*d* comprises—as is particularly clarified by FIG. 5—a holed, angle-shaped arm 2*d* and a holed box portion 2*f*, through which holes the attachment pin of the fifth roller 10 runs. The said holes in the box portion 2*f* are slightly larger than is necessary for the attachment pin, the latter being held in the wanted position by, for instance, a locking screw or stop screw 2*m* screwed into the end surface of the box portion 2*f*. A limited movement between the third arm 2*d* and the box portion 2*f* is therefore permitted in that they are limitedly mutually pivotally via a screw 20 or similar, which is screwed into the box portion 2*f* and runs through an oblong hole in the third arm 2*d*, and via an adjusting screw 2*k*, with the aid of which the distance between the third arm 2*d* and the box portion 2*f* is variable. By manipulation of the adjusting screw 2*k* the axis of rotation of the fifth roller 10 can thus be varied, a circumstance which has the consequence that the machining belt 5 migrates upwards or downwards on the peripheral surface of the fifth roller 10 and thereby also on the peripheral surface of the sixth roller 11, provided that the direction of rotation of the machining belt 5 is chosen from the fifth roller 10 to the sixth roller 11. If the adjusting screw 2*k*—or if the direction of belt rotation is reversed the adjusting screw 2*j*—is replaced by for example some suitable device which generates periodically varying distances between the third arm 2*d* and the box portion 2*f*, the result will be an oscillating machining belt 5 between the rollers 10 and 11.

The fourth arm 2*b* has, in similarity with the third arm 2*d*, a box portion 2*e*, the fourth arm 2*b* being mirror-imaged in relation to the third arm 2*d* and being provided in the same manner as the third arm 2*d* with an adjusting screw 2*j* of the same design and with the same task as the adjusting screw 2*k*.

One difference between the third arm 2*d* and the fourth arm 2*b* is that, for example, the first-mentioned arm via, for instance, a piston and cylinder device 13 actuable from the control panel 12 is arranged to balance the lower belt loop with rollers and attachment device at an altered angular position, whereupon the stationary portion of the said piston and cylinder device 13 is for example pivotally anchored in the first arm 2*c*, while its movable piston portion is pivotally anchored in the third arm 2*d*—see particularly FIG. 5.

The third and fourth arms are further mutually rigidly connected together via the box portions 2*f* and 2*e* by means of a cross brace 21—see particularly FIG. 1—and a locking tongue 15 is carried connected to the said cross brace 21—see particularly FIG. 5—with a handle 16 and with a preferably manually adjustable contact device 22 (pressure shoe plate), appropriately actuated by a pneumatic cylinder, for a replaceable, appropriately time-controlled support plate 23, the outer shape of which is beneficially adapted in shape to the workpiece which—on the existing machining occasion—is intended to be machined and/or to the shape to which the workpiece is intended to be machined.

The said locking tongue 15 has such a large extent directed from the cross brace 21 and inwards towards the pillar 17 that it always—regardless of the angular position set between the third arm 2*d* and the first arm 2*c*—is in a position between a stationary portion anchored in the pillar of an extended locking device 14 and the movable part of the locking device 14. The said locking device 14 can also be advantageously manoeuvred from the control panel 12. On activation of the movable part of the locking device 14 the locking tongue 15 is thus locked and upon deactivation the locking tongue 15 is released, whereupon the position of the machining belt 5 is hereby either fixed or becomes alterable, the latter case being determined to advantage by gripping handle 16 manually and moving this to the intended position, whereupon the locking device 14 is again activated and thus locks the locking tongue 15, preventing any further movement thereof.

Figure 3:
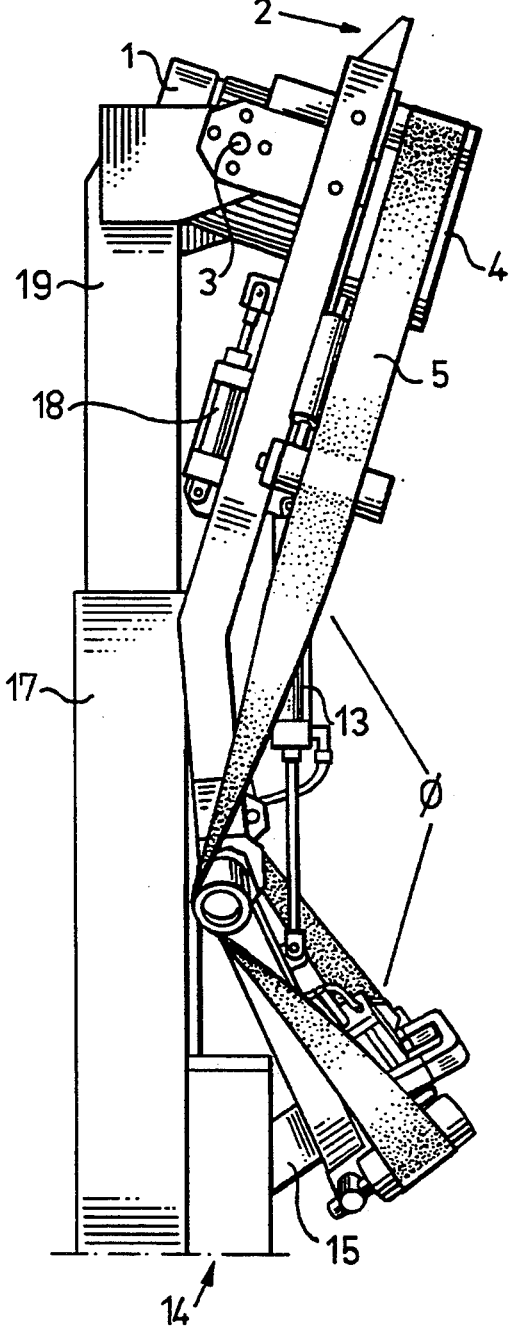
FIG. 3 shows essentially the same position for the machine as illustrated in FIG. 2 but with the machine seen from the side.

The endless belt 5 intended for machining is passed across the drive wheel 4 of the motor 1, diverted in direction by the first roller 6, diverted in direction and twisted by the third roller 8, diverted in direction and twisted by the fifth roller 10, run straight between the fifth roller 10 and the sixth roller 11, between which rollers 10 and 11 machining of a workpiece is intended to take place, is diverted in direction and twisted by the fourth roller 9, is diverted in direction and twisted by the second roller 7 and, finally, back to the drive wheel 4 of the drive motor 1. By this means there always thus arise momentaneously two portions of the belt loop, which have an angle $\phi$ in relation to one another—see FIG. 3—which as explained above for reasons that will be explained in greater detail below is alterable in magnitude.

A workpiece—not shown in the drawings—which is to be machined, for instance ground on one vertical side, is continuously fed in a manner not shown forwards towards that portion of the machining belt 5 which for the moment is located between the rollers 10 and 11—see FIG. 1—and at the position for the workpiece where machining is to be commenced the support plate 23 is activated—for example time-controlled and/or position-controlled by the workpiece—by the contact device 22 to present its surface profile, which comprises the counterprofile to the wanted machining of the workpiece, against the back of the machining belt 5, the workpiece thereby being ground to a shape determined by the surface profile of the support plate 23. When the wanted machining has been performed on the workpiece, the contact device 22—for example time-controlled and/or position-controlled by the workpiece—feeds the support plate 23 away from the back of the machining belt 5.

In this context it should be noted that the remaining belt loop 5 has a large length in relation to the section 5*d* of the loop 5 which momentaneously machines the workpiece, namely between the rollers 10 and 11, whereby removal of machined material from the workpiece becomes effective and the belt loop 5 will have a long, effective operating period before it needs to be replaced. It should also be observed that all parts of the belt loop 5 are readily accessible from the same direction, namely from that side of the machine on which the control panel 12 is situated, whereby changes of machining belt 5, settings, angle resettings, manoeuvering, etc., can be performed rapidly and easily when necessary, without the operator of the machine needing to go round the machine in order to, for example, change the machining belt 5.

When machining inclined surfaces of a workpiece, which as a rule but not always are fed forwards essentially in the same vertical level as in the workpiece example above, a changed contact direction for the machining belt loop 5 is necessary. A changed contact direction—see FIG. 2 and FIG. 3—is accomplished partly by altering the angle $\phi$ by releasing, via control panel 12, the locking device 14 for the locking tongue 15, and partly by raising or lowering the guide or guides 19 by actuation of the piston and cylinder device—not shown in the drawings—preferably disposed in the pillar 17 or, in applicable cases, by means of a corresponding mechanical movement device's handwheel—and resetting of the angle $\phi$ can be performed either manually by first releasing the locking device 14 and altering the angle $\phi$ by lifting or lowering the handle 16 and/or by actuating via the control panel 12 the angle-determining piston and cylinder arrangement 13 and thereafter again advancing the movable portion of the locking device 14 towards the locking tongue 15. It should be noted that the pivotal attachments of the arms 2*d* and 2*b* in the arms 2*c* and 2*a* are located at relatively short distances from the attachments of the rollers 10 and 11, whereby small or no adjustments are required of the belt tension when altering the direction of contact against the workpiece of the machining belt 5.

The alteration of the angle $\phi$ that can be maximally made is between 180 degrees and 0 degrees, whereas the commonest angular changes are between about 45 degrees and 135 degrees.

In the description the rollers are described as being journalled, but naturally use can also be made of other members, such as sliding surfaces with low friction, to change the running direction of the belt 5 in different sections.

Since the largest part of the belt loop 5 always runs essentially in a vertical direction, the need of horizontal extents for the machine will be minimal.

The invention described here is applicable to virtually all types of machines which make use of closed loops for machining, among which may be mentioned by way of example wood, plastic and metal grinding machines, wood plastic and metal polishing machines, trimming machines etc.

Variations of the invention are naturally possible within the compass of the appended claims. For example, the resetting of the machine, here essentially shown and described as raising and lowering relative to the pillar 17, can instead be directed in any desired direction whatsoever by, for instance, the pillar 17 being inclined in different directions or being resettable at different angles, the guide member 3 can be positioned to work in any wanted direction whatsoever, the suspension device 2 can alternatively be located on either side of the pillar 17 or on any side whatsoever of the pillar 17, the drive wheel 4 and the first roller 6 and/or the second roller 7 can be replaced by a drive wheel of larger diameter, drive wheel, motor, resetting members, setting members, adjustments, locking devices, etc. can be embodied and located in ways and positions respectively other than those described here, and so on.

I claim:

1. An apparatus arranged for at least one of grinding, and polishing, comprising:

a closed loop belt (5) mounted on an output shaft of a motor (1);

at least one drive wheel (4) coupled to said motor output shaft for driving said closed loop belt (5);

said closed loop belt (5) being appliable against a workpiece which is to be machined by means of said closed loop belt (5), said closed loop belt (5) having a plurality of loop portions differing from one another in a respective dimension thereof in a running direction of said closed loop belt;

steering members (8, 9; 10, 11) coupled to said closed loop belt (5) for steering said closed loop belt (5) to adopt an essentially L-shape;

one of said plurality of loop portions (5*d*) of said closed loop belt (5) that is appliable against said workpiece being shorter than other ones of said plurality of loop portions (5*a*, 5*b*, 5*f*, 5*g*);

a foundation (17) on which said apparatus is mounted;

said at least one drive wheel (4) being movable relative to said foundation (17) by a guide means (19) that is steered by said foundation (17);

guide members (3) provided for the guide means (19) for twisting said at least one drive wheel (4); and resetting means (16) and locking means (14) for respectively resetting and locking an angle $\phi$ formed between arms of the L of the L-shaped closed loop belt.

2. The apparatus as claimed in claim 11, wherein the shorter loop portion (5*d*) of the closed loop belt (5) comprises three sequentially arranged loop portions (5*c*, 5*d*, 5*e*), of which a middle loop portion (5*d*) is the shorter loop portion that is appliable to the workpiece.

3. The apparatus as claimed in claim 2, wherein the middle loop portion (5*d*) comprises a small portion of a total length of said closed loop belt (5), thereby increasing a life expectancy of said closed loop belt (5).

4. The apparatus as claimed in claim 1, wherein:

said steering members (8, 9; 10, 11) are arranged into at least one pair of steering members, each steering member of said at least one pair of steering member being located at a same distance from a respective end of said shorter loop (5*d*) of said plurality of loops of said closed loop belt (5); and said at least one pair of steering members together providing a pairwise steering of the closed loop belt (5) to move at least two of said plurality of loop portions in one of identical and opposing running directions.

5. The apparatus as claimed in claim 1, wherein said steering members (8, 9; 10, 11) are arranged into at least first and second pairs of steering members (8, 9; 10, 11), said first pair (8, 9) of steering members being displaced in relation to said second pair of steering members (10, 11) so that said first and second pairs of steering members steer at least two of said plurality of loop portions of the closed loop belt (5) to run in mutually opposite directions.

6. The apparatus as claimed in claim 2, wherein said steering members (8, 9; 10, 11) convert a movement and a turning of the drive wheel (4) into a twisting of said shorter loop portion (5*d*) of said closed loop belt (5), and provide an angle of less than 180° at a level for the shorter loop portion (5*d*).

7. The apparatus as claimed in claim 11, further comprising:

a suspension device (2);

said steering members (8, 9; 10, 11) and the motor (1) with said drive wheel (4) being suspended in said suspension device (2);

said suspension device (2) being turnable via said guide members (3) relative to said guide means (19); and said suspension device (2) being movable by a movement of said guide means (19).

8. The apparatus as claimed in claim 7, wherein:

said drive wheel (4) along with the motor (1) are movably arranged relative to said suspension device (2) in an immediate vicinity of one end of the suspension device (2);

said suspension device (2) comprising:

a first pair of separated arms (2*a*, 2*c*) which are rigidly mutually connected in said one end (FIG. 1, upper end) of said suspension device (2);

said drive wheel being positioned between said first pair of arms (2*a*, 2*c*) of said suspension device (2) to be movable;

said first pair of arms (2*a*, 2*c*) each having an end portion that is located away from said drive wheel (4), said end portions of said first pair of arms which are positioned away from said drive wheel (4) being substantially rigidly and pivotally interconnected with a respective one of a further pair of arms (2*b* and 2*d*);

said further pair of arms (2*b*, 2*d*) having respective end portions which are located away from said first pair of arms (2*a*, 2*b*);

said respective end portion of said further pair of arms (2*b*, 2*d*) being rigidly connected together adjacent to said respective end portions thereof; and pivot connection means for pivotally connecting said first pair of arms of said suspension device (2) respectively to one of said further pair of arms which are substantially rigidly interconnected such that said steering members (8, 9, 10, 11) provide different running directions for different ones of said plurality of loop portions.

9. The apparatus as claimed in claim 8, wherein said steering members (8, 9, 10, 11) comprise pairs of journalled rollers (8, 9, 10, 11), each pair of journalled rollers having one of essentially a common axis of rotation and mutually parallel axes of rotation; and both journalled rollers of one pair of said journalled rollers rotating in a same direction of rotation as each other and another pair of said journalled rollers having a direction of rotation that is opposite to said same direction of rotation of said one pair.

10. The apparatus as claimed in claim 9, wherein each of said journalled rollers (8, 9, 10, 11, 6, 7) has a substantially cylindrical outer surface that has a width which exceeds a width of said closed loop belt (5).

11. The apparatus as claimed in claim 9, wherein at least one journalled roller (10 or 11) in one of the pairs of journalled rollers has an axis of rotation that is one of intermittently and continuously varied.

12. The apparatus as claimed in claim 9, wherein at least one journalled roller (10 or 11) in one of the pairs of journalled rollers has an axis of rotation that is one of intermittently and continuously varied (2*k* or 2*j*).

13. The apparatus as claimed in claim 6, wherein the shorter loop portion (5*d*) is positioned to be in a substantially horizontal plane.

* * * * *